United States Patent [19]

Magorian et al.

[11] 4,424,745

[45] Jan. 10, 1984

[54] DIGITAL TIMER FUZE

[75] Inventors: William R. Magorian, China Lake; Kenneth R. Wetzel, Ridgecrest, both of Calif.

[73] Assignee: The United States of America as represented by the Secretary of the Navy, Washington, D.C.

[21] Appl. No.: 238,709

[22] Filed: Mar. 24, 1972

[51] Int. Cl.[3] ..... F42C 11/06; F42C 13/06; F42C 15/40

[52] U.S. Cl. ..... 102/215; 102/206

[58] Field of Search ..... 102/70.2 R, 70.2 P

[56] References Cited

U.S. PATENT DOCUMENTS

| | | | |
|---|---|---|---|
| 3,125,026 | 3/1964 | Johnson | 102/214 |
| 3,500,746 | 3/1970 | Ambrosini | 102/215 X |
| 3,657,571 | 4/1972 | Martin et al. | 102/215 |

*Primary Examiner*—David H. Brown

*Attorney, Agent, or Firm*—Robert F. Beers; W. Thom Skeer

[57] ABSTRACT

A digital timer fuze (DTF) in subcombination with a digital timer fuze system. The central element in the fuze system is the aircraft fire-control computer including a fuze setter, which receives input signals from various sensors as required for rocket trajectory computations and, in addition, pilot commands. When the pilot arms the system and selects a firing mode, power is supplied to each fuze in the load. When the firing button (pickle switch) is depressed, timing commands are injected into each fuze in proper sequence and the rocket motors are initiated via circuits and initiators incorporated in the launcher pods. As each rocket moves forward under motor thrust, the lead to its fuze is separated. Physical interruption of this circuit initiates the "run" phase of the digital timer fuze.

The digital timer fuze is electrically connected to the fuze setter. A signal from the fuze setter charges a power supply capacitor and causes a counter to count clock pulses for a given period of time and store the count. When the umbilical line connecting the fuze to the fuze setter is severed, the main counter counts down at a given rate. When all of the stored counts have left the counter, the counter gates an SCR which allows the power supply capacitor to actuate the detonator.

2 Claims, 4 Drawing Figures

DIGITAL TIMER FUZE

BACKGROUND OF THE INVENTION

1. Field of the Invention.

This invention pertains to digital timer fuzes (DTF) and systems associated therewith.

2. Description of the Prior Art.

Time fuzes are widely used in Navy weapons principally because they are less costly than proximity fuzes. This advantage, however, is offset by a compromise in weapon performance, since fuze function time is a tradeoff based on the statistical average of typical weapon deployments. Also, when launching air-to-surface weapons, the pilot is constrained to a specific weapon delivery flight envelope to maintain weapon effectiveness. As a result of such repeated trajectories, the launch aircraft is more vulnerable to hostile action.

Because it is settable, the proposed DTF system can be used in place of conventional fixed-timer fuzes to provide improved weapon performance with an enlarged launch envelope. This system would also permit the use of low-cost time fuzing in some applications that previously required higher-cost active or proximity fuzing. For example, the DTF could replace costly autonomous slant-range fuzes, which function at ranges from several hundred feet to over 1,000 feet. In such instances, a cost saving in expended fuze hardware of approximately 30 to 1 could be realized.

The advanced capabilities of high accuracy (approximately 0.1%) and almost instantaneous settability (a few milliseconds) offered by the DTF open many new military applications for a timer of this type. However, only the air-to-surface weapon application will be addressed here. By replacing fixed-delay timers, the DTF can greatly enlarge the launch envelope of such weapons. In addition to providing the pilot with greater flexibility in his weapon delivery tactics, weapon effectiveness can be maximized for each launch. This can be accomplished by accurately determining the optimum warhead function time for each weapon to be launched, and by setting each fuze accordingly the instant before launch. Such a procedure involves (1) acquisition of geometric and kinematic data to define the weapon trajectory after launch,(2) manipulation of this data to obtain the optimum fuze delay time for the weapon to be launched, and (3) setting the fuze delay time before launch.

DESIGN CONSIDERATIONS

In the technical approach to an optimum fuze design, the type of timer to be used is a prime consideration.

Electrical timers have four significant advantages over mechanical timers: (1) the electrical timer is capable of an almost infinite variation of delay time settings; (2) the delay time can be remotely set through an electrical circuit; (3) the time interval required to set the timer can be made quite brief, allowing the timer to be set at the instant of weapon release; and (4) the accuracy of an electrical timer can be improved over that of mechanical timers in the same cost range.

There are two basic types of electrical timers: analog and digital. An analog timer typically uses the time required for a capacitor to discharge energy through a resistor as the timing element. Associated threshold/fire and setting circuits complete such a timer. A digital timer typically employs a stable oscillator and a digital counter as the timing element. A firing circuit and setting circuit complete this timer.

At first appearance the analog approach may seem more straightforward; however, several features make digital implementation more attractive. First, because of the nature of integrated-circuit technology, the digital format is more readily integrated into a monolithic large-scale integrated circuit. This is important in that large-scale mass-production costs are drastically reduced. Second, the digital timer can be made at least 10 times more accurate than the best analog version. Third, digital timers can be made more immune to inaccuracies and significant unit-to-unit variations introduced in production. Fourth, the digital timer is more immune to environmental variations and adverse environments than the analog timer.

SUMMARY OF THE INVENTION

The invention comprises a digital timer fuze in which the input logic and a set/count gate causes an up/down counter to count first up then down. An umbilical line connects the fuze to a fuze setter, which is a subsystem of a fire-control computer located in an aircraft. A signal from the fuze setter charges a power supply capacitor and causes the counter to count up a given number of counts. When the missile is fired and the umbilical line is severed the counter counts down a number equal to the number of up counts and then gates an SCR firing circuit allowing the power supply capacitor to discharge into the detonator.

DESCRIPTION OF THE PREFERRED EMBODIMENT

Figure 1:
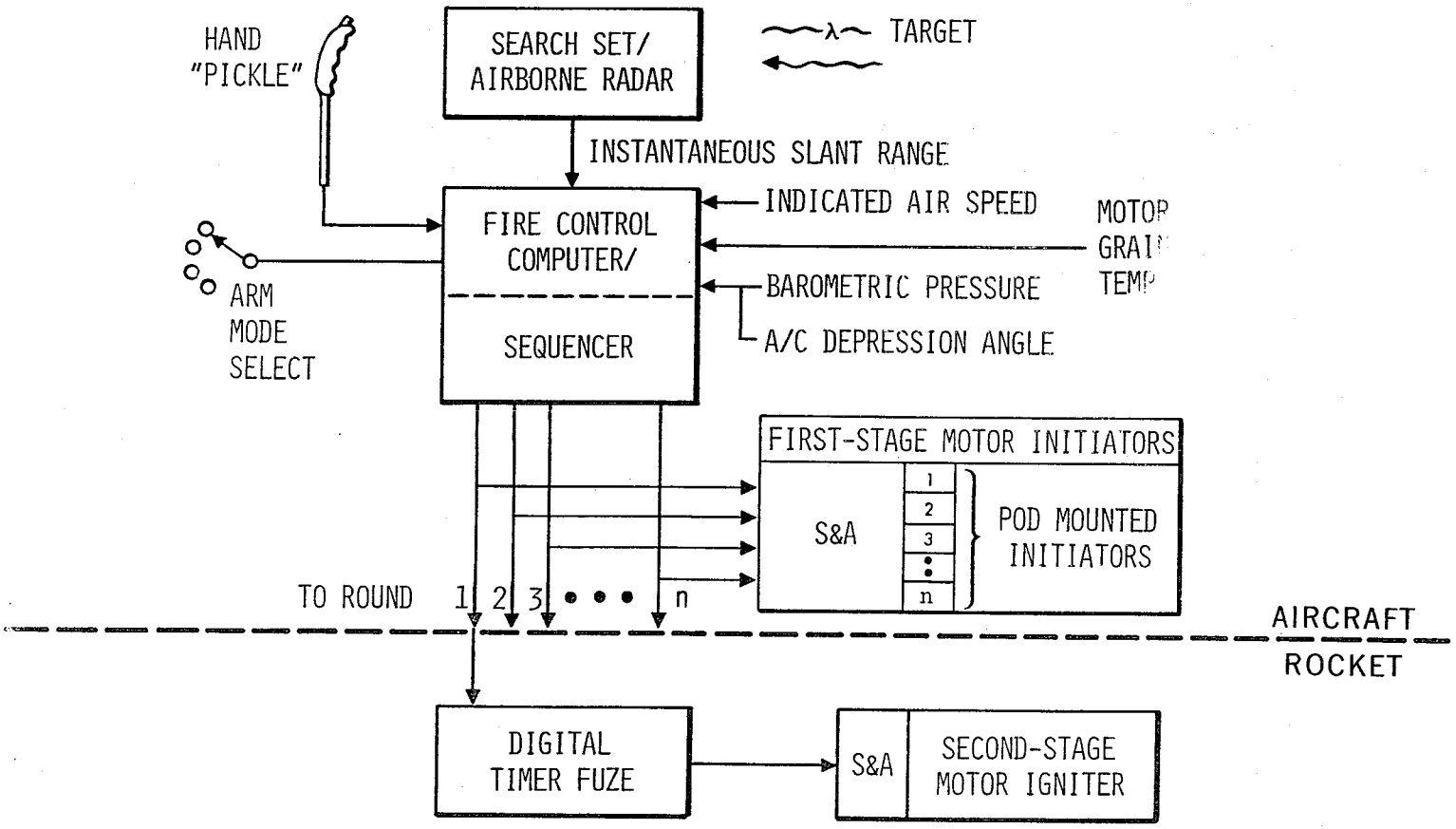
FIG. 1 shows a block diagram of the digital timer fuze system including the aircraft-rocket interface.

The digital timer fuze (DTF) system consists of expendable digital timer fuzes, a timer setter, a control computer, and the associated avionics for sufficiently accurate trajectory prediction. The set/count gate, 128 divider, OR gate, and 4,096-bit up/down counter are comprised of complementary-symmetry MOS digital integrated circuits.

The central element is the aircraft fire-control computer which includes a fuze setter which receives input signals from various sensors as required for rocket trajectory computations and, in addition, pilot commands. When the pilot arms the system and selects a firing mode, power is supplied to each fuze in the load. When the pickle switch is depressed, timing commands are injected into each fuze in proper sequence and the rocket motors are initiated via circuits and initiators incorporated in the launcher pods. As each rocket moves forward under motor thrust, the lead to its fuze is separated. Physical interruption of this circuit initiates the "run" phase of the digital timer fuze.

If the system is switched to "disarm" at any point in this sequence prior to separation of the fuze umbilical lead, each fuze will revert automatically to a "safe" condition within one minute.

When the DTF is energized by application of +15 volts through the umbilical line, the power supply capacitor is charged by the charging diode. The 128 divider and the up/down counter also are cleared at this time. The instant before launch, the umbilical voltage drops to zero for approximately 20 microseconds and then goes to −15 volts for the carefully controlled set pulse time period, after which the voltage returns to zero. While the umbilical voltage is negative, clock pulses are passed directly to the main counter, which is in the "up" counting mode. The length of this set pulse determines the number of clock pulses that are set into the counter. These clock pulses are stored in the main counter until counted out during the timed weapon flight interval or until otherwise removed. The delay time countdown of the stored clock pulses begins when physical separation of the umbilical line from the fuze is sensed by the input logic circuit. During weapon flight, the main counter is in the "down" mode and counts out each clock pulse that was counted in during the setting interval. On the last pulse the counter triggers the silicon-controlled rectifier (SCR), which fires the detonator, electric initiator, or similar load. The DTF functions independently once the weapon has been separated from the parent aircraft.

The pulses stored in the main counter after the set pulse can be removed in a number of ways. If the fire control system is turned off before the weapon is launched, or if a hang-fire occurs, the stored pulses will be lost when the power supply capacitor becomes discharged. The time required for the capacitor to discharge is about three times the maximum delay time. If the pilot aborts a weapon delivery maneuver, the fuze can be cleared of the previous time setting by the application of a new energizing pulse.

The DTF was designed to operate with a single coaxial umbilical cable. The sequence of positive and negative setting voltages provides one way of obtaining single wire operation. However, a variety of other techniques may be used, one of which may prove more compatible for use with large-scale integrated circuitry.

The three-stage clock circuit is used to obtain a stable clock frequency with minimum power consumption, a crucial factor to consider when the power is supplied by a capacitor. The supply voltage regulator maintains a constant supply voltage to the multivibrator as the power supply capacitor discharges. The output driver interfaces the clock to the digital integrated circuits.

It should be understood that the actual clock frequency, within the limits described in the appendix, is of little importance. The following derivations will verify this statement.

Figure 2A:
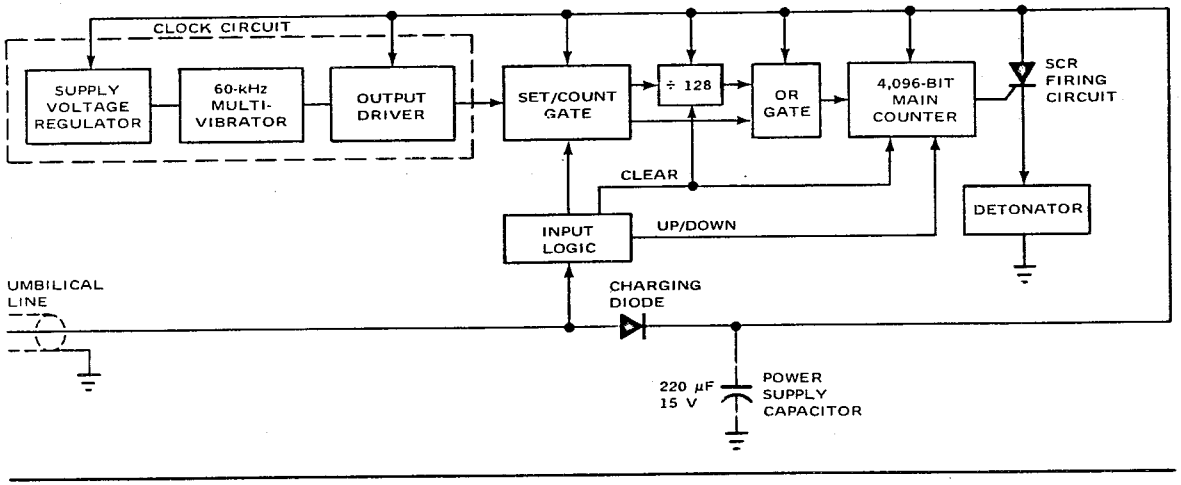
FIG. 2A is a block diagram of the digital timer fuze circuit.
Figure 2B:
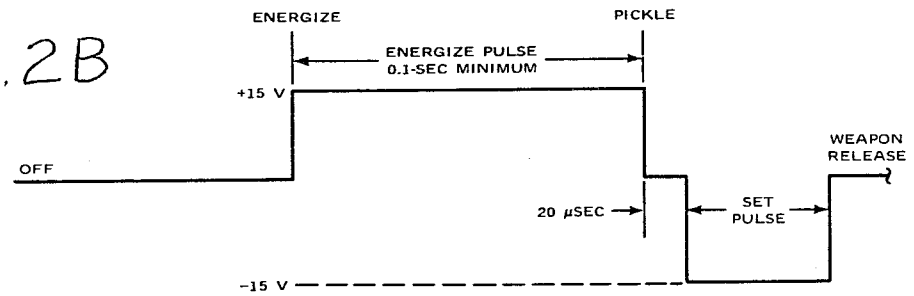
FIG. 2B shows the electrical waveform which is applied through the umbilical line.
Figure 3:
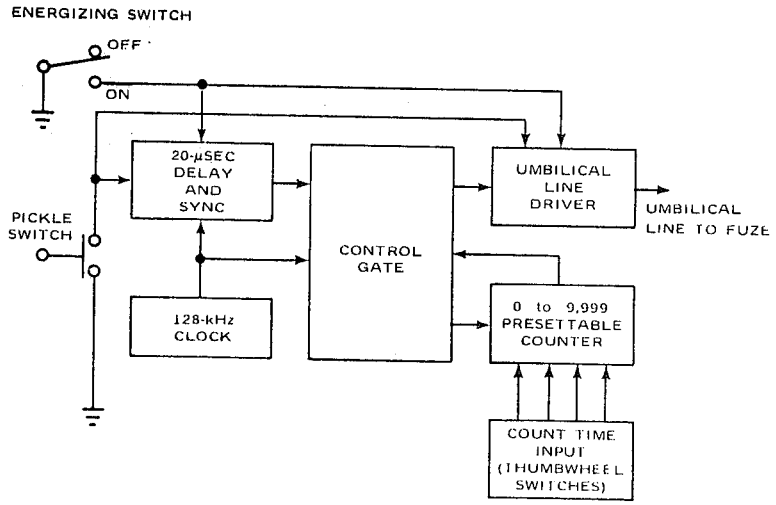
FIG. 3 is a block diagram of the fuze setter which is a subsystem of the fire-control computer.

Letting $f_c$=the clock frequency in hertz $n_c$=the number of clock pulses stored in the main counter $N_d$=the set-time compression factor, which is determined by the divide ratio of the divider $t_d$=the delay time, or the duration of the timed interval, in seconds $t_s$=the duration of the set pulse in seconds (refer to FIG. 2B)

The number of clock pulses in the counter due to the set pulse is $$n_c \pm 1 = f_c t_s \quad (1)$$

The ±1 count error is inherent with gated digital signals. The number of clock pulses counted out is $$n_c = (f_c/N_d)t_d \quad (2)$$

Solving for $t_d$ gives $$t_d = t_s\left(N_d \pm \frac{N_d}{f_c}\right) \quad (3)$$

If $f_c$ is considerably larger than $1/t_s$, which is normally the case, the delay time is determined soley by the set time and the set-time compression factor.

The set/count gate steers the clock pulses for setting or counting. The 128 divider provides the required slow clock rate during countdown. For fast setting of the counter, the clock pulses bypass the 128 divider. Equation 3 shows that the ratio of count time to set time is determined by the size of this divider. The OR gate directs either the slow clock frequency or the fast clock frequency into the main counter. The main counter is composed of three four-stage binary up/down counters, which provide the demonstration unit with a maximum of 4,096 discrete time settings. The last count from the main counter provides the trigger pulse for the SCR. The SCR is a low-cost, low-current SCR with a 25-ampere peak current rating. The power supply capacitor is a small electrolytic capacitor, and the charging diode is a low-cost silicon diode.

SETTER

The presettable counter is the principal component of this setter. A time setting can be preset into the counter at any time before the pickle switch is depressed. The required input is a parallel binary-coded decimal (BCD) format. In the setter the input is set by several BCD switches and the outputs are fed through a diode matrix to obtain the proper code for the presettable counter. The output of the umbilical line driver is at ground potential and the 20-microsecond delay is blocked as long as the energizing switch is off. When the switch is turned on, the output immediately rises to +15 volts to charge the power capacitor in the fuze; simultaneously, the 20-microsecond delay is enabled to allow a pickle pulse to pass. After a minimum of 100 milliseconds, the capacitor in the fuze is fully charged and the fuze is ready to accept a set pulse. When the pickle switch is pressed, the line driver output immediately returns to ground potential. The pickle pulse is then delayed approximately 20 microseconds and is synchronized with the 128 kHz clock to assure that the set-pulse width is an integral number of setter clock pulses. The 20-microsecond delay is incorporated to assure proper timing of the set pulse through the fuze input logic. The delayed pickle pulse turns the control gate on, which passes clock pulses to the presettable counter and simultaneously causes the umbilical line driver output to drop to −15 volts. The counter counts the number of clock pulses and, on the last pulse required to equal the preset number, the counter delivers an output pulse that turns the gate off. This stops the counter and causes the line driver voltage to return to ground potential. The DTF is now charged, set, and ready to start the countdown upon separation.

Appendix

TIMER DESIGN PARAMETERS AND EQUATIONS

The parameters of maximum delay time, delay time precision (the number of increments in the delay time interval), and maximum set time-all of which are variables left to the choice of the designer—were selected arbitrarily for the DTF unit. The basic parameter is delay time precision, or the number of counts the main counter can store. In the DTF UNIT, the main counter has a capacity of 4,096 counts, which yields approximately 0.1% delay time precision. The ratio between the set time and the corresponding delay time is determined by the size of the divider (128 in FIG. 2A). The clock frequency is constrained by the desired maximum delay time, the maximum acceptable increment of the delay time, and the sizes of the divider and main counter. In the case of the DTF demonstration unit, the requiured clock frequency was determined to be 60 kilohertz. The relationships between these parameters are described in the follow equations.

The size of the divider is determined by the equation $$N_d = \frac{t_d(\max)}{t_s(\max)} \tag{4}$$

where $N_d$=the set-time compression factor $t_d(\max)$=the maximum design delay time $t_s(\max)$=the maximum acceptable set time To keep complexity low, the actual divider size, $N_d'$, should be equal to $2^n$, where n is the number of binary stages in the divider. Since the calculated value of $N_d$ usually implies a noninteger value of n, the next larger integer value would be selected. The actual maximum set time, $t_s'(\max)$, can be found from $$t'_s(\max) = \frac{t_d(\max)}{N'_d} \tag{5}$$

The size of the main counter, $N_C$, is found from $$N_C = \frac{t_d(\max)}{t_i(\max)} \tag{6}$$

where $t_i(\max)$=the maximum acceptable increment of the delay time. $N_C$ usually implies a noninteger value of n. Again, the next larger value of the actual counter size, $N_C'$, should be selected. In determining the clock frequency, the upper and lower limits, $f_c(\max)$ and $f_c(\min)$, respectively, must be determined from $$f_c(\max) = \frac{N'_C N'_d}{t_d(\max)} \tag{7}$$

$$f_c(\min) = \frac{N'_d}{t_i(\max)} \tag{8}$$

The nominal clock frequency, $f_c(\text{nom})$, is then determined from $$f_c(\text{nom}) = \sqrt{f_c(\max) f_c(\min)} \tag{9}$$

and the permissible tolerance (in percent) for the frequency of the clock, $\delta f_c$, is found by $$\delta f_c = 100\left(\sqrt{\frac{f_c(\max)}{f_c(\min)}} - 1\right) \tag{10}$$

Since $f_c(\max)$ and $f_c(\min)$ are determined by different criteria, it is possible that the clock frequency tolerance $\delta f_c$, will be smaller than desired or even negative. In this case it is necessary to select the next larger $N_C'$ and reevaluate. The required short-term clock stability, $\delta f_{cst}$ (in percent), is given by $$\delta f_{cst} = \frac{100 t_i(\max)}{t_d(\max)} \tag{11}$$

This stability must be maintained from the beginning of the set time interval to the end of the delay time.

An example may clarify the application of these formulas. From a hypothetical system performance goal the following parameters were established:

$t_i(\max)$=25 msec $t_d(\max)$=45 sec $t_s(\max)$=100 msec

From Equation 4 the size of the divider is determined $$N_d = \frac{t_d(\max)}{t_s(\max)} = \frac{45 \text{ sec}}{0.1 \text{ sec}} = 450$$

The next higher integral $2^n$ is 512, with n=9. From Equation 5 the actual maximum set time is $$t'_s(\max) = \frac{t_d(\max)}{N'_d} = \frac{45 \text{ sec}}{512} = 87.89 \text{ msec} \tag{12}$$

The size of the main counter from Equation 6 is $$N_C = \frac{t_d(\max)}{t_i(\max)} = \frac{45 \text{ sec}}{0.025 \text{ sec}} = 1{,}800 \text{ counts} \tag{13}$$

The next larger integral, $2^n$, is 2,058, which represents an 11-stage binary counter. Thus, $N_C'$=2,048. The upper and lower limits of the clock frequency, from Equation 7 and 8, are $$f_c(\max) = \frac{N'_C N'_d}{t_d(\max)} = \frac{2{,}048(512)}{45 \text{ sec}} = 23.30 \text{ kHz} \tag{14}$$

$$f_c(\min) = \frac{N'_d}{t_i(\max)} = \frac{512}{0.025 \text{ sec}} = 20.48 \text{ kHz} \tag{15}$$

Equations 9 and 10 yield the nominal clock frequency and the required clock frequency tolerance $$f_c(\text{nom}) = \sqrt{f_c(\max) f_c(\min)} = 21.84 \text{ kHz} \tag{16}$$

$$\delta f_c = 100\left(\sqrt{\frac{f_c(\max)}{f_c(\min)}} - 1\right) = 6.7\% \tag{17}$$

This required clock frequency tolerance would be unacceptable for any mass-produced clock except a crystal-controlled clock. To permit greater flexibility in clock design, the actual main counter size, $N_C'$, is increased by one stage. The new $N_C'$is $$N_C' = 4{,}096 \tag{18}$$

Equations 7, 9, and 10 are reevaluated to yield the following results $$f_c(\max)=46.60\ \text{kHz} \tag{19}$$

$$f_c(\text{nom})=30.89\ \text{kHz} \tag{20}$$

$$\delta f_c=50.8\%,\ \text{a generous tolerance} \tag{21}$$

The required short term clock stability from Equation 11 is $$\delta f_{cst}=\frac{100t_i(\max)}{t_d(\max)}=\frac{100(0.025)}{45}=0.056\% \tag{22}$$

Referring to Equation 8, if $f_c(\min)$ is replaced by $f_c(\text{nom})$ and $t_i(\max)$ by $t_i(\text{nom})$, and the equation is solved for $t_i(\text{nom})$, the following results are found $$t_i(\text{nom})=\frac{N_d}{f_c(\text{nom})}=\frac{512}{30.89\ \text{kHz}}=16.6\ \text{msec} \tag{23}$$

The nominal time increment now has been considerably improved over that of the design specifications. This improvement and the improved clock specifications resulted from the addition of one more counter stage to the existing 20 stages. This addition represents a 5% increase in complexity, with better than a 40% nominal performance increase. This type of performance improvement versus added complexity is characteristic of digital systems and is in direct contrast to analog systems, where added complexity produces light performance improvement.

We claim:

1. A digital timer fuze for a weapon comprising;
a clock circuit for providing a series of pulses at a stable frequency;
an up/down counter electrically connected to operate in its up counting mode for storing said clock circuit pulses and to operate in its down counting mode to count out the pulses stored;
logic means electrically connected to said up/down counter and said clock circuit for controlling said up/down counter in either its up or down modes;
firing circuit means having a detonator and electrically connected to receive an electrical impulse from said up/down counter upon counting out of all pulses stored; and
power supply means connected to said detonator for supplying energy to fire said detonator.

2. The fuze of claim 1 further comprising:
a power supply capacitor supplying power to said fuze upon launch of said missile;
said clock circuit comprising a voltage regulator, multivibrator, and output driver respectively being connected in series;
said driver being connected to said counter by gating means.

* * * * *